US007914337B1

(12) United States Patent
Li et al.

(10) Patent No.: US 7,914,337 B1
(45) Date of Patent: Mar. 29, 2011

(54) ELECTRICAL CONNECTOR WITH ADJACENT TERMINALS BENT OUTWARD

(75) Inventors: Shou-Sheng Li, Santa Ana, CA (US); Shun-Guo Jiang, Santa Ana, CA (US)

(73) Assignee: I/O Interconnect, Ltd., Santa Ana, CA (US)

( * ) Notice: Subject to any disclaimer, the term of this patent is extended or adjusted under 35 U.S.C. 154(b) by 0 days.

(21) Appl. No.: 12/817,453

(22) Filed: Jun. 17, 2010

(30) Foreign Application Priority Data

Dec. 18, 2009 (TW) ..... 98223744 U

(51) Int. Cl.
*H01R 24/00* (2006.01)
*H01R 33/00* (2006.01)

(52) U.S. Cl. ..... 439/660

(58) Field of Classification Search ..... 439/660, 439/626, 83, 607.01, 212
See application file for complete search history.

(56) References Cited

U.S. PATENT DOCUMENTS 4,737,115 A * 4/1988 Seidler ..... 439/83
7,534,141 B1 * 5/2009 Wu ..... 439/607.01
7,637,782 B1 * 12/2009 Yang et al. ..... 439/626
2006/0128197 A1 * 6/2006 McGowan et al. ..... 439/212
2009/0042450 A1 * 2/2009 Zheng et al. ..... 439/660

* cited by examiner

*Primary Examiner* — Chandrika Prasad
(74) *Attorney, Agent, or Firm* — Kirton & McConkie; Evan R. Witt

(57) ABSTRACT

An electrical connector includes an insulating body, a plurality of first terminals, a plurality of second terminals and a shielding shell. A base on the insulating body includes a first solder portion, a second solder portion and a connection portion. The first solder portion and the second solder portion are located on the one end of the base, and the connection portion is located on the other end of the base. The first terminals run through the base, and are arranged parallel to each other and located on two sides of the first soldering portion and the connection portion. The second terminals run through the base, and are separately located on two sides of the second soldering portion and the connection portion. At least two of the second terminals are bent outwardly at a predetermined angle, so that the cross talk between two adjacent second terminals can be reduced. The shielding shell sleeves on the connection portion. Additionally, the thicknesses of the first solder portion and the second solder portion both are 1.20 mm so that the cross talk of the second terminals located at the two sides of the second solder portion can be reduced.

7 Claims, 3 Drawing Sheets

ELECTRICAL CONNECTOR WITH ADJACENT TERMINALS BENT OUTWARD

CROSS-REFERENCE TO RELATED APPLICATION

This application claims the priority benefit of Taiwan application serial no. 098223744, filed on Dec 18, 2009. The entirety of the above-mentioned patent application is incorporated herein by reference and made a part of this specification.

BACKGROUND

1. Technical Field

The present invention relates to an electrical connector, and more particularly to an electrical connector with a USB 2.0 interface and a USB 3.0 interface. At least two of the second terminals located at two sides of the USB 3.0 interface are bent outwardly at a predetermined angle, so that cross talk between adjacent two second terminals can be reduced.

2. Description of the Related Art

Currently, due to the plug and play function, peripheral devices with USB interfaces become popular. A data transfer rate provided by the USB 2.0 protocol may be as high as 480 Mbit/s. However, with the development of multimedia technology, it takes more than ten minutes if a multimedia file of 25 GB is downloaded with the USB 2.0 protocol and that may not satisfy consumers' demand. Therefore, the USB 3.0 protocol providing a data transfer rate as high as 4.8 Gbit/s is introduced, so that the time consumed for downloading the multimedia file of 25 GB with the USB 3.0 is one-tenth of the consumed time with the USB 2.0 protocol.

Generally, a conventional USB 2.0/USB 3.0 electrical connector has a plurality of solder joints, which are arranged parallel to each other and separated from each other with a fixed distance. FIG. 1 shows a schematic view of a conventional electrical connector. Referring to FIG. 1, the conventional USB 2.0/USB 3.0 electrical connector 100 includes an insulating sheet 110 with a plurality of solder joints 120. The solder joints 120 are arranged parallel to each other and provided for soldering with cables 130. However, the electrical connector 100 has the following shortcomings: (1) since the solder joints 120 are arranged parallel to each other and separated from each other with a fixed distance, when the USB 3.0 protocol is applied, strong cross talk would be generated between the solder joints 120 due to the relatively small distance between the solder joints 120; (2) the thickness of the insulating sheet 110 of the electrical connector 100 is only about 1.0 millimeter, that is, the distance between the solder joints 120 on opposite sides of the insulating sheet 110 is too small, so that the cross-talk would also be increased between the solder joints 120 easily. A structure similar to the electrical connector 100 is disclosed, for example, in FIGS. 38-45 of U.S. Patent Publication No. US2009/0042450A and in FIG. 2 of U.S. Pat. No. 7,534,141.

Therefore, it is necessary to design a new electrical connector that can overcome the above-mentioned shortcomings.

BRIEF SUMMARY

The present invention relates to an electrical connector with a USB 2.0 interface and a USB 3.0 interface. At least two of the second terminals located at the two sides of the USB 3.0 interface are bent outwardly at a predetermined angle, so that cross talk between two of the second terminals can be reduced.

The present invention also relates to an electrical connector, wherein the thickness of the solder portion is 1.20 millimeter, so that the cross talk between the second terminals located at two sides of the solder portion can be reduced.

The present invention provides an electrical connector. The electrical connector includes an insulating body, a plurality of first terminals, a plurality of second terminals and a shielding shell. One end of a base disposed on the insulating body has a first solder portion and a second solder portion, and another end of the base has a connection portion. The first terminals run through the base. The first terminals are arranged parallel to each other and located on two sides of the first solder portion and the connection portion. The second terminals run through the base. The second terminals are located on two sides of the second solder portion and the connection portion. At least two of the second terminals located on the two sides of the second solder portion are bent outwardly at a predetermined angle, so as to increase a distance between two adjacent second terminals and reduce cross talk between the two adjacent second terminals. The shielding shell sleeves on the connection portion and is used for reducing electromagnetic interference between the first terminals and the second terminals.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
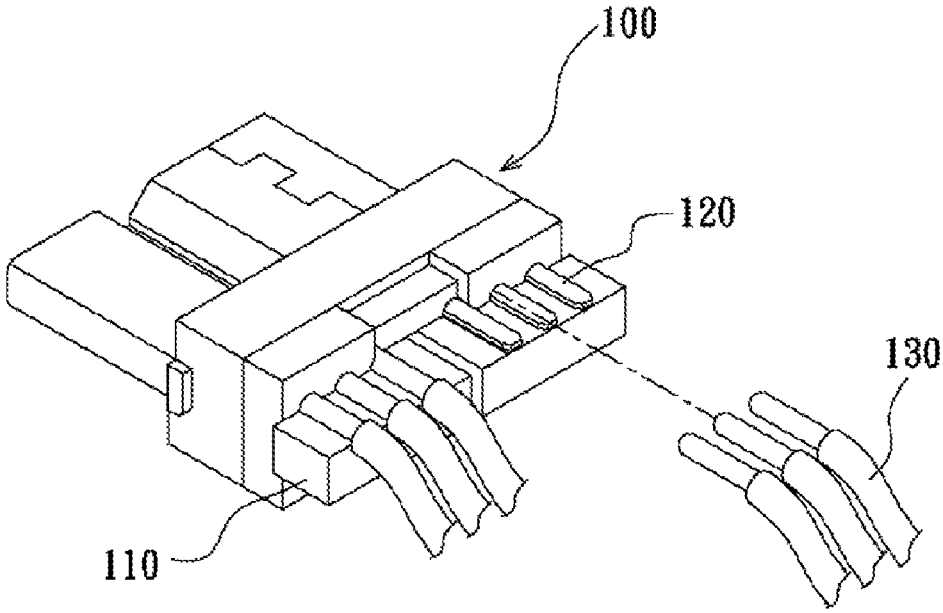
FIG. 1 is a schematic view of a conventional electrical connector.
Figure 2:
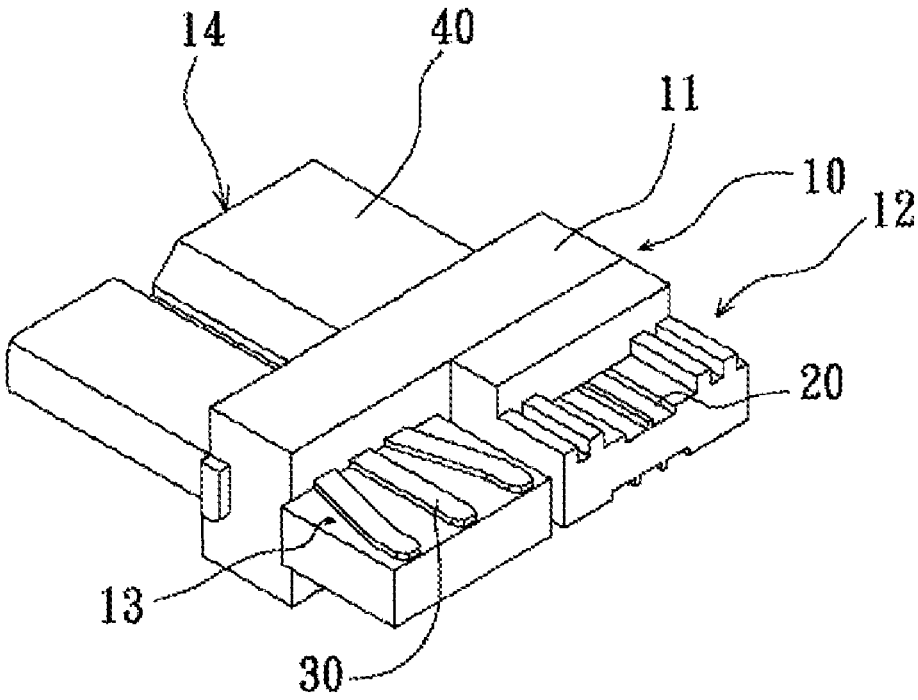
FIG. 2 is a schematic view of an electrical connector according to an embodiment of the present invention.
Figure 3D:
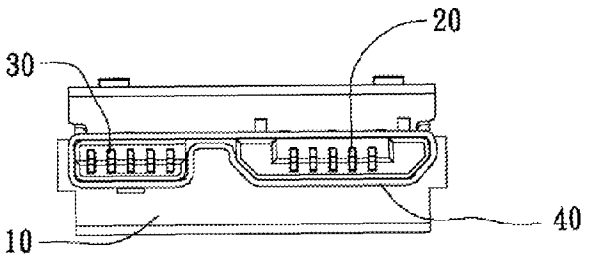
FIG. 3*d* is a front view of the electrical connector of FIG. 2.
Figure 3B:
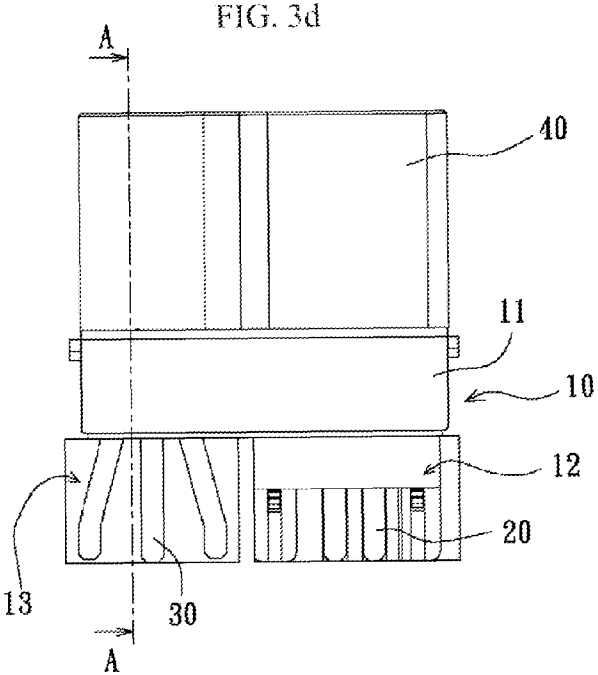
FIG. 3*b* is a bottom view of the electrical connector of FIG. 2.
Figure 3C:
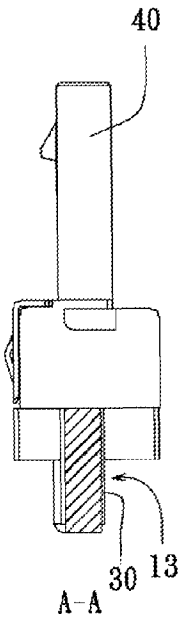
FIG. 3*c* is a schematic cross-sectional view of the electrical connector of FIG. 3*b*, taken along line A-A thereof.
Figure 3A:
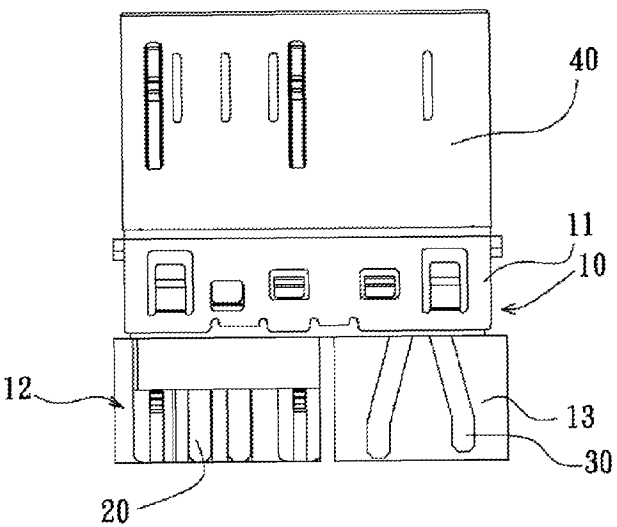
FIG. 3*a* is a top view of the electrical connector of FIG. 2.

FIG. 2 is a schematic view of an electrical connector according to an embodiment of the present invention. FIG. 3*a* is a top view of the electrical connector according to an embodiment of the present invention. FIG. 3*b* is a bottom view of the electrical connector according to an embodiment of the present invention. FIG. 3*c* is a schematic cross-sectional view of the electrical connector shown in FIG. 3*b*, taken along line A-A thereof. FIG. 3*d* is a front view of the electrical connector according to an embodiment of the present invention.

Referring to FIGS. 2-3*d*, the electrical connector of the embodiment of the present invention includes an insulating body 10, a plurality of first terminals 20, a plurality of second terminals 30 and a shielding shell 40.

The insulating body 10 can be made of insulating material, such as plastic, but not limited hereto. A base 11 is disposed on the insulating body 10. The base 11 includes a first solder portion 12, a second solder portion 13 and a connection portion 14. The first solder portion 12 and the second solder portion 13 are located on one end of the base 11 and the connection portion 14 is located on another end of the base 11. The thicknesses of the first solder portion 12 and the second solder portion 13 both can be 1.20 millimeter, but not limited hereto. The thicknesses of the first solder portion 12 and the second solder portion 13 are greater than that of the insulating sheet 110 of the conventional electrical connector 100, therefore the cross talk between the second terminals 30 on opposite sides of the second solder portion 13 can be reduced.

The plurality of first terminals 20 run through the base 11. The first terminals 20 are arranged parallel to each other and located on the two sides of the first solder portion 12 and the connection portion 14. The first terminals 20 can be USB 2.0 terminals, but not limited to, and the number of the first terminals 20 can be five.

The second terminals 30 also run through the base 11. The second terminals 30 are located on two sides of the second solder portion 13 and the connection portion 14. At least two of the second terminals 30 located on the two sides of the second solder portion 13 are bent outwardly at a predetermined angle, so as to increase a distance between two adjacent second terminals 30 and reduce cross talk between the two adjacent second terminals 30. The predetermined angle can be in the range from 25° to 40°, and is preferably 30°. The second terminals 30 can be USB 3.0 terminals, but not limited to, and the number of the second terminals 30 can be five.

The shielding shell 40 sleeves on the connection portion 14 and is used for reducing electromagnetic interference between the first terminals 20 and the second terminals 30. The shielding shell 40 can be made of metal.

As shown in FIGS. 3*a*-3*d*, in the electrical connector of the embodiment of the present invention, because the two second terminals 30 of USB 3.0 located on the two sides of the second solder portion 13 are bent outwardly at about 30°, the distance between two adjacent second terminals 30 increases obviously and the cross talk between the two adjacent second terminals 30 can be reduced. In addition, as shown in FIG. 3*c*, the thicknesses of the first solder portion 12 and the second solder portion 13 both are 1.20 millimeter, which is greater than that of the insulating sheet 110 of the conventional electrical connector 100. Therefore the cross talk between the second terminals 30 on the opposite sides of the second solder portion 13 can be reduced. Consequently, for comparing with the conventional electrical connector, the electrical connector of the embodiment of the present invention is creative.

In summary, the electrical connector of the present invention has at least the following advantages. First, at least two second terminals 30 are bent outwardly at about 30° to increase the distance between the two adjacent second terminals 30, so the cross talk between the two adjacent second terminals 30 can be reduced. Second, the thickness of the second solder portion 13 is 1.20 millimeter, so the cross talk between the second terminals 30 on the opposite sides of the second solder portion 13 can be reduced. Therefore, the shortcomings of the conventional electrical connector can be overcome by the electrical connector of the present invention.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An electrical connector, comprising:

an insulating body with a base disposed thereon, one end of the base has a first solder portion and a second solder portion, and another end of the base has a connection portion;

a plurality of first terminals running through the base, arranged parallel to each other and separately located on two sides of the first solder portion and the connection portion;

a plurality of second terminals running through the base, separately located on two sides of the second solder portion and the connection portion, wherein at least two adjacent second terminals located on at least one side of the second solder portion bent outwardly at a predetermined angle, so as to increase a distance between the two second terminals and reduce cross-talk between the two second terminals; and a shielding shell sleeving on the connection portion to reduce electromagnetic interference between the first terminals and the second terminals.

2. The electrical connector as claimed in claim 1, wherein the first terminals are USB 2.0 terminals, and the number of the first terminals is five.

3. The electrical connector as claimed in claim 1, wherein the second terminals are USB 3.0 terminals, and the number of the second terminals is five.

4. The electrical connector as claimed in claim 3, wherein the whole second terminals located on the two sides of the second solder portion bent outwardly at the predetermined angle, so as to increase the distance between two adjacent second terminals.

5. The electrical connector as claimed in claim 1, wherein the predetermined angle is in the range from 25° to 40°.

6. The electrical connector as claimed in claim 1, wherein the thicknesses of the first solder portion and the second solder portion both are 1.20 millimeter, so as to reduce cross-talk between the second terminals on the two sides of the second solder portion.

7. The electrical connector as claimed in claim 1, wherein the shielding shell is made of metal.

* * * * *